US006135001A

United States Patent [19]

Miazga et al.

[11] Patent Number: 6,135,001

[45] Date of Patent: Oct. 24, 2000

[54] STRIP CUTTER FOR ADHESIVE-BACKED MEDIA

[75] Inventors: Jay Miazga; Pixie Ann Austin; Duane M. Fox, all of Marysville, Wash.

[73] Assignee: Intermec Corporation, Everett, Wash.

[21] Appl. No.: 09/162,932

[22] Filed: Sep. 29, 1998

Related U.S. Application Data

[62] Division of application No. 08/369,632, Jan. 6, 1995, Pat. No. 5,813,305.

[51] Int. Cl.[7] ..... B26D 14/00

[52] U.S. Cl. ..... 83/508; 83/508.2; 83/164

[58] Field of Search ..... 83/168, 346, 347, 83/566, 569, 658, 659

[56] References Cited

U.S. PATENT DOCUMENTS

| | | | |
|---|---|---|---|
| 1,336,239 | 4/1920 | Kinraide | 83/168 |
| 2,039,457 | 5/1936 | Schober | 83/168 |
| 2,143,123 | 1/1939 | Erickson | 83/168 |
| 2,676,641 | 4/1954 | George | 83/168 |
| 3,540,166 | 11/1970 | Crumley | 83/168 |
| 3,614,906 | 10/1971 | Hall | 83/659 |
| 4,003,276 | 1/1977 | Schmitt | 83/659 |
| 4,574,817 | 3/1986 | Suzuki et al. | 83/168 |
| 4,653,363 | 3/1987 | Lang | 83/347 |
| 4,996,901 | 3/1991 | Fullerton | 83/564 |
| 5,357,831 | 10/1994 | Michalik | 83/347 |

FOREIGN PATENT DOCUMENTS

| | | | |
|---|---|---|---|
| 1208875 | 10/1970 | United Kingdom | 83/168 |

*Primary Examiner*—M. Rachuba
*Attorney, Agent, or Firm*—Donald A. Streck; Joan H. Pauly

[57] ABSTRACT

This is a cutter assembly for linerless strip media having an uncovered adhesive backing. There is a cutter for transverse movement across the media and a backing bar with at least two cutting edges. The backing bar can be rotated to place one of the cutting edges in contact with the cutter. A cleaning station cleans the previously used cutting edge as the bar is rotated. Rotating and fixed cutters can be used. The cutter is replaceable and can be supplied in combination with as associated media for which it is designed. The cutter may partially cut the media to make it separate without fouling the cutter with adhesive. A self-healing "solid" roller is also disclosed.

20 Claims, 12 Drawing Sheets

10
22
12
14'

10
22
16
60
14'''

10
22
12
14'

10
22
32
14''

10
22
16
18

STRIP CUTTER FOR ADHESIVE-BACKED MEDIA

This application is a division of application Ser. No. 08/369,632, filed Jan. 6, 1995 U.S. Pat. No. 5,813,305.

BACKGROUND OF THE INVENTION

1. Technical Field

This invention relates to power cutters as employed in printers, plotters, and the like for cutting strip media and, more particularly, to a cutter assembly for linerless strip media having an uncovered adhesive backing comprising a cutter having a cutter blade mounted to cut the media transversely, and a backing bar including a plurality of longitudinal resiliently flexible fingers that form a cylindrical supporting surface for the media, wherein the media is supported by a pair of adjacent fingers and the cutting blade pierces the media between the pair of fingers.

2. Background Art

Power cutters are used in a variety of roll-fed media devices including, plotters, printers, facsimile machines, and the like. A typical prior art approach is shown in FIGS. 1 and 2. The rotary cutting blade wheel 10 moves along the cutting edge 12 of the backing bar 14 creating a scissors-like cutting action to cut the media 16 as depicted in FIG. 3. A cutting bar is sometimes used instead of the wheel 10 in a guillotine type cutting action or against a surface in an anvil type of cutting action. All these prior art approaches work well for their intended purpose with a hard-surfaced media such as facsimile paper, plotting paper, printing paper, or the like. They can even work without undue problems when the media has a liner-covered adhesive backing if properly designed and maintained.

For various reasons not important to the invention, so-called linerless adhesively attachable media is presently being employed in many applications such as labels, and the like, provided in roll form that must be cut to length at time of use. By coating the non-adhesive carrying surface of the media with a release coating, the linerless media can be rolled and unrolled without sticking together. Thus, the separate liner material previously used to cover the adhesive during storage and rolling prior to use can be eliminated. The negative aspect of rolled linerless media comes when prior art cutting mechanisms are employed in the roll-fed printers using the media to create labels and the like. As depicted in FIG. 4, the adhesive 18 soon builds up on the rotary cutting blade wheel 10 as well as the cutting edge 12 and opposite top edge of the backing bar 14 thereby gumming up the feed mechanism and preventing the media 16 from moving through the printer in a normal manner. The adhesive 18 can also cause the cutting action of the cutting apparatus to deteriorate rapidly.

Wherefore, it is an object of the present invention to provide methods and apparatus for cutting roll-supplied linerless media which will not allow the adhesive to gum up the device's feed mechanism.

It is another object of the present invention to provide methods and apparatus for cutting roll-supplied linerless media which will not allow the adhesive to cause the cutting action of the cutting apparatus to deteriorate rapidly.

Other objects and benefits of this invention will become apparent from the description which follows hereinafter when read in conjunction with the drawing figures which accompany it.

SUMMARY OF THE DISCLOSURE

The foregoing objects have been achieved by the cutter assembly for strip media of the present invention comprising cutter means having a cutting blade mounted to cut the media transversely at a point of cutting, and backing bar means. The backing bar means comprises a plurality of longitudinal resiliently flexible fingers that form a cylindrical supporting surface for media. The media is supported by a pair of adjacent fingers. The cutter means pierces the media between the pair of fingers.

Preferably, the fingers are sufficient in number and are close enough together such that the backing bar acts like a self-healing solid roller with respect to the cutting blade. Also preferably, the fingers are of a material that does not stick to adhesive whereby a cut portion of media having uncovered adhesive on a face thereof adjacent to the fingers can be advanced after cutting by rotation of the backing bar. Another preferred feature is a cleaning station positioned to clean end portions of the fingers as the fingers are rotated, by rotation of the backing bar, out of a position supporting the media.

The preferred embodiment also includes a carriage assembly movable transversely across the media; an arm having a first end pivotally carried by the carriage assembly and a second end carrying the cutter means; exchange means for releasably holding the cutter means on the second end; and spring bias means for biasing the second end of the arm towards the backing bar. Additionally, it includes a cam follower carried by the arm and a cam member positioned to engage the cam follower at an end of the backing bar. The cam member has a first portion which engages the cam follower to move the cutting blade away from the backing bar a sufficient clearance distance to allow the backing bar to rotate. The cam member also has a second portion which engages the cam follower to move the cutting blade into an access position for changing the cutting blade.

In one embodiment, the cutting blade comprises a rotating blade wheel and the exchange means comprises a post on the arm releasably receiving and holding the blade wheel.

In another, embodiment there is a housing; the cutting blade comprises a rotating blade wheel carried by the housing; and the exchange means comprises means on the arm for releasably receiving and holding the housing.

In still another embodiment employing the housing, the cutting blade comprises a non-rotating cutting blade carried by the housing.

Where the media is an adhesive-backed media, the transverse cutting action of the cutter means may cut through only a portion of the thickness of the media so as to prevent adhesive fouling of the cutting blade.

In another aspect of the invention, the cutting blade has a depth of cut and cutting angle sized for optimum performance with the media and the cutter means is a replaceable cutter means provided in combination with the media.

DETAILED DESCRIPTION OF THE PREFERRED EMBODIMENT

Figure 3:
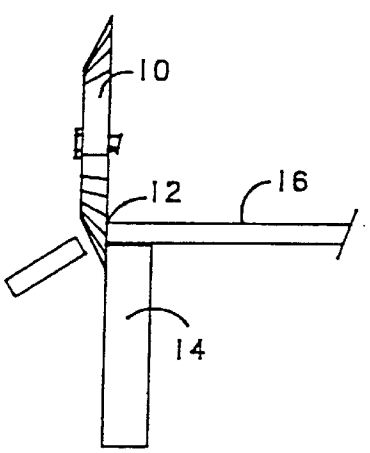
PRIOR ART FIG. 3
FIG. 3 shows the apparatus of FIG. 1 in the process of cutting a strip of media.
Figure 2:
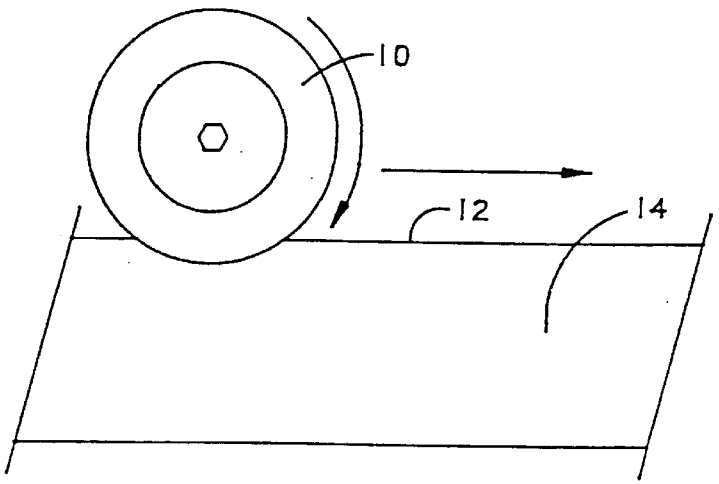
PRIOR ART FIG. 2
FIG. 2 is a side view of the apparatus of FIG. 1.
Figure 4:
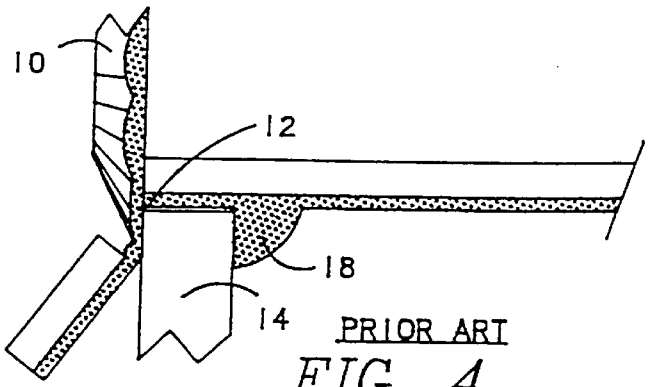
PRIOR ART FIG. 4
FIG. 4 shows how the prior art cutting apparatus of FIGS. 1 and 2 gums up when used to cut adhesive-backed media.
Figure 1:
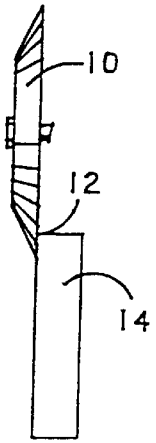
PRIOR ART FIG. 1
FIG. 1 is a simplified end view drawing of a prior art power strip cutter.
Figure 5:
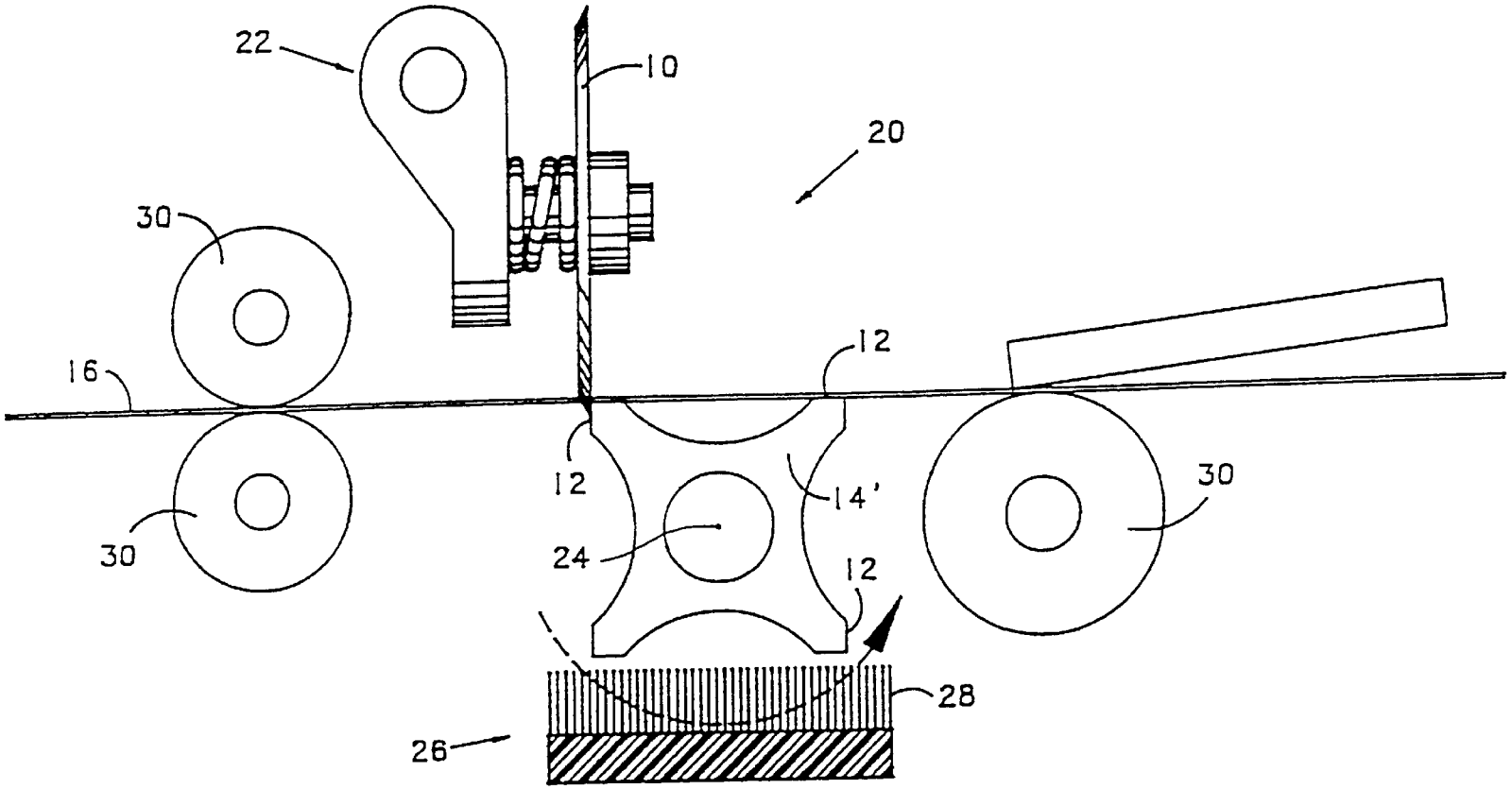
FIG. 5 is an end view of cutting apparatus according to the present invention in a basic embodiment.

The basic elements of the present invention are depicted in FIG. 5. The cutting apparatus 20 comprises a cutting blade wheel 10 rotatably carried by a cutting blade wheel carriage assembly 22 and a backing bar 14' mounted for rotation about its transversely extending longitudinal axis 24. As can be seen, the backing bar 14' has multiple cutting edges 12. Each cutting edge 12 includes a pointed portion 12A and a corresponding support surface 12B, both referenced in FIG. 22. Preferably, there is a cleaning station 26 through which the cutting edges 12 are rotated to remove any adhesive 18 that may adhere to the cutting edges 12. The cleaning station 26 can have scrubbing bristles 28 and may be saturated with an oil or other adhesive removing liquid.

Figure 6:
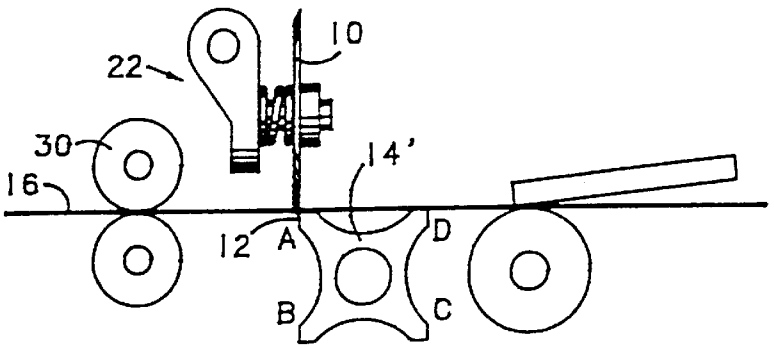
FIGS. 6 through 8 show how the apparatus of FIG. 5 rotates the backing bar to expose a clean cutting edge, clean a previously used cutting edge, and advance the media strip in a manner which does not wipe adhesive off on the new cutting edge.
Figure 7:
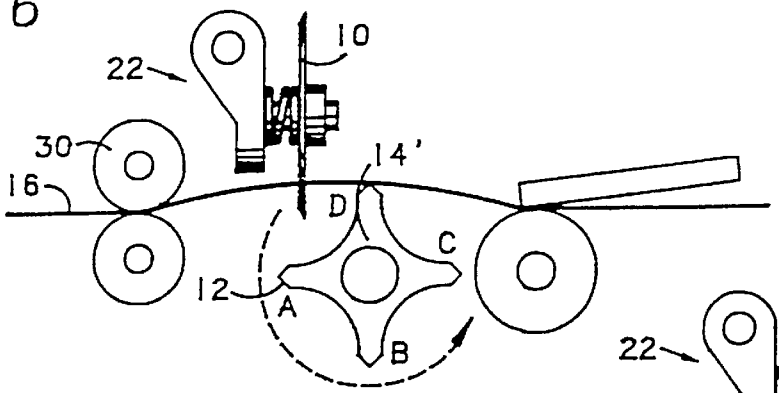
Figure 8:
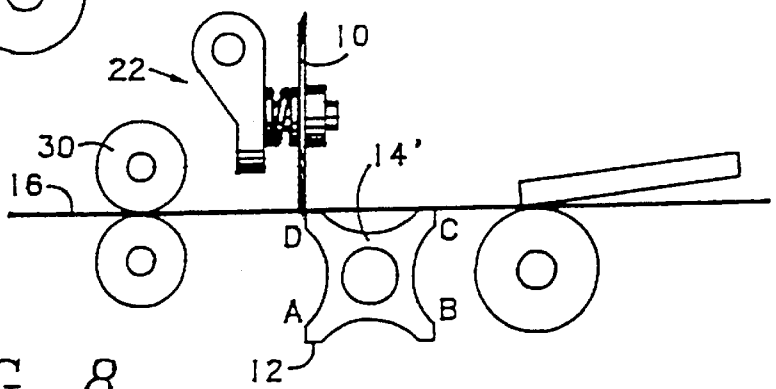

The operation of the backing bar 14' is depicted in simplified form in FIGS. 6–8. It will be addressed in greater detail shortly. In FIG. 6, the media 16 is being cut by the wheel 10 in combination with the cutting edge 12 labeled "A". In FIG. 7, the media 16 is being moved by the feed rollers 30 while at the same time the backing bar 14' is rotated to its next cutting position. The rotational speed of the backing bar 14' is the same as the forward speed of the media 16. For that reason, the media rides up on the point 12A of the cutting edge 12 labeled "D" rather than sliding across the backing bar 14' as in the prior art described above. Thus, there is no opportunity for the adhesive 18 to be dragged across an edge and be transferred thereto. In FIG. 8, the backing bar 14' has arrived at its next cutting position and the media 16 is being cut by the wheel 10 in combination with the cutting edge 12 labeled "D".

The backing bar 14' can take many cross sectional shapes to achieve the objects of the present invention. The backing bar 14' of FIGS. 5–8 has four cutting edges 12 (A, B, C, & D). It was chosen for convenience only and does not necessarily represent a preferred number of cutting edges. Any number of cutting edges 12 are to be considered within the scope and spirit of the present invention as is the use of a non-rotating cutter and a guillotine type of cutter against one of a plurality of anvil surfaces. For example, FIG. 9 depicts a backing bar 14' with two cutting edges 12 while FIG. 11 has twelve cutting edges, and FIG. 12 shows a backing bar 14" with twelve cutting anvil surfaces 32.

Figures 9, 10, 11, 12, 13:
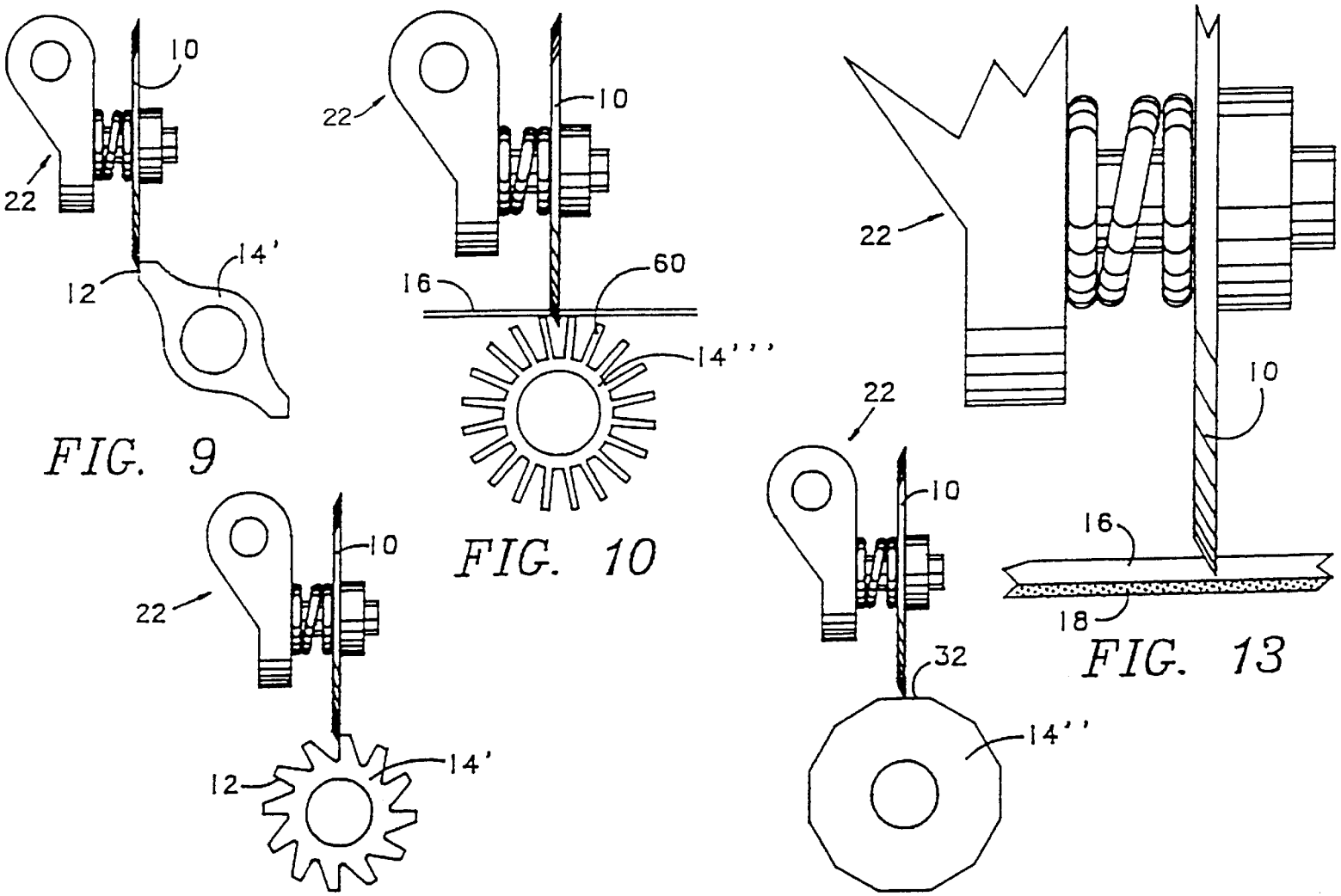
FIG. 9 shows an alternate cross sectional configuration for a backing bar according to the present invention used for a scissors type cutting action as in FIG. 5.
FIG. 10 shows another possible cross sectional configuration for a backing bar according to the present invention in which the backing bar is a "self-healing" bar comprised of a number of resiliently flexible fingers which support media under a piercing cutter roller.
FIG. 11 shows still another possible cross sectional configuration for a backing bar according to the present invention used for a scissors type cutting action as in FIG. 5.
FIG. 12 shows an alternate cross sectional configuration for a backing bar according to the present invention used for a blade and anvil type cutting action.
FIG. 13 is a greatly enlarged drawing of a cutting blade wheel according to the present invention in a preferred implementation wherein the blade cuts the media to a frangible thickness but does not contact the adhesive so as to keep the blade free of adhesive.
Figure 10A:
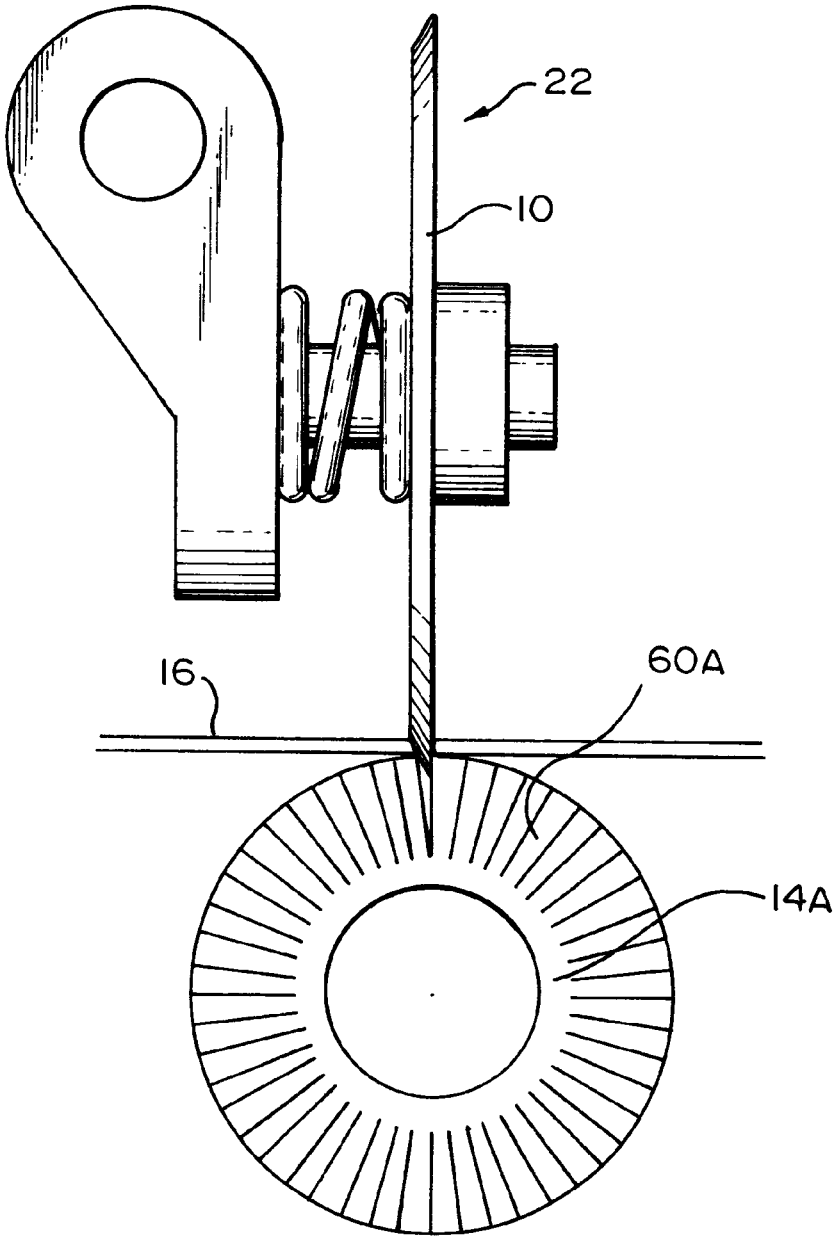
FIG. 10A is similar to FIG. 10 but shows the backing bar with more fingers to better form a "self-healing" solid roller.

A slightly different approach according to the present invention is depicted in FIG. 10. In this embodiment, the backing bar 14'" has twenty resiliently flexible fingers 60. The "soft" fingers 60 support the media 16 closely enough on either side of the piercing cutting blade wheel 10 such that the support of the media 16 is stiff enough that the cutting blade wheel 10 will part the media 16. The fingers 60 form a cylindrical supporting surface for the media. The media is supported by a pair of adjacent fingers 60, and the cutting blade wheel 10 pierces the media between the pair of adjacent fingers 60. Referring to FIG. 10A, if the fingers 60A are numerous and close enough in spacing, the backing bar 14''', 14A will behave as a "self-healing" solid roller. If the backing bar 14A''', is made of a non-stick material such as the material sold under the trademark Teflon, it will easily advance the cut end of a linerless media when rotated. The backing bar 14''', 14A may also be used in conduction with a cleaning station as otherwise described herein for cleaning any clinging adhesive from the ends of the fingers 60.

Other important aspects and considerations of the present invention are depicted in part in FIG. 13. With prior art cutters, adhesive fouling was not a consideration. Moreover, each device typically employs a single type of media or multiple medias that can be cut successfully by a common cutter. When addressing the problem of a printer employing different types of media employing various types of adhesive in a linerless mode of operation, performance can be optimized by taking previously ignored factors into consideration such as depth of cut and angle of cutting edge. Thus, one aspect of the present invention not present in the prior art is to have the cutting blade wheel 10 replaceable when wear occurs or when a different cutting angle and depth of cut will provide improved performance. In this regard, another aspect of the invention is to have the supplier provide the rolled media 16 in combination with a cutting blade wheel 10 having the optimum depth of cut and cutting angle for the material of the media 16 and the adhesive 18 employed therewith.

Figure 14:
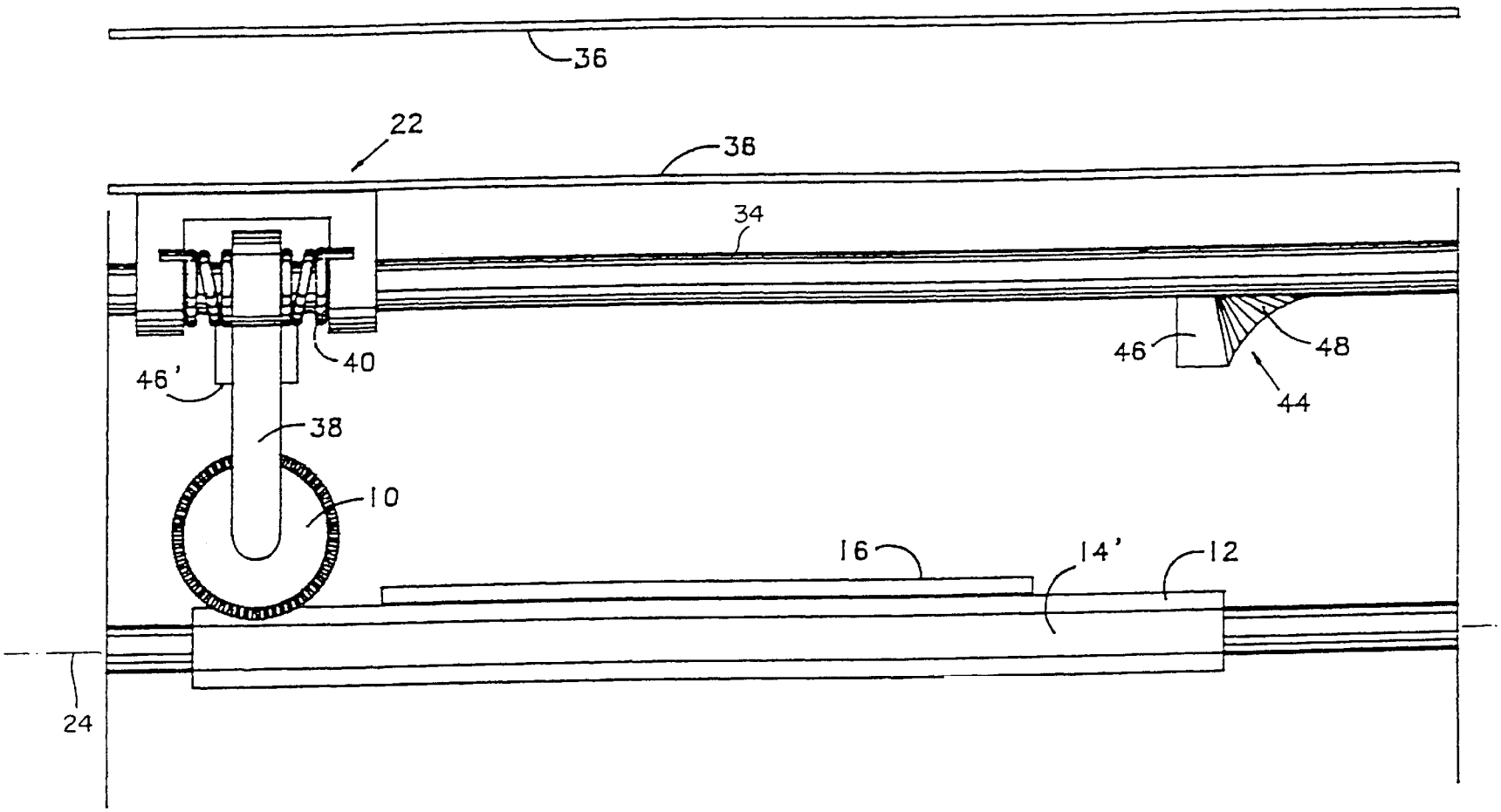
FIG. 14 is a back view of cutting apparatus according to the present invention including a rotatable backing bar and replaceable cutting blade wheel shown with the cutting blade wheel positioned for media movement and prior to cutting.

Turning now to FIGS. 14 through 17 in combination with FIGS. 18 through 22, certain aspects of the present invention as described above will now be described in greater detail. FIG. 14 shows the carriage assembly 22 slidably mounted on a cylindrical carriage bar 34. The carriage assembly 22 is carried by and bi-directionally movable by a powered drive belt 36. Alternatively, of course, it could be moved by a lead screw, solenoid, or pneumatic or hydraulic cylinder, or the like. The blade wheel 10 is carried by an arm 38 of the carriage assembly 22. The arm 38 is both slidably and rotatably mounted on the carriage bar 34. The blade wheel 10 and arm 38 are biased towards the backing bar 14' by the spring 40. The spring 40 may also be used to bias the blade wheel 10 against the cutting edge instead of the spring 41 depicted in FIGS. 18–22. The arm 38 also includes a cam follower in the form of a follower wheel 42 as best seen with reference to FIGS. 18–22. There is a cam member 44 at the end of the backing bar 14' opposite the position of the carriage assembly 22 shown in FIG. 14. The follower wheel 42 and the cam member 44 interact in a manner to be described shortly.

Figure 15:
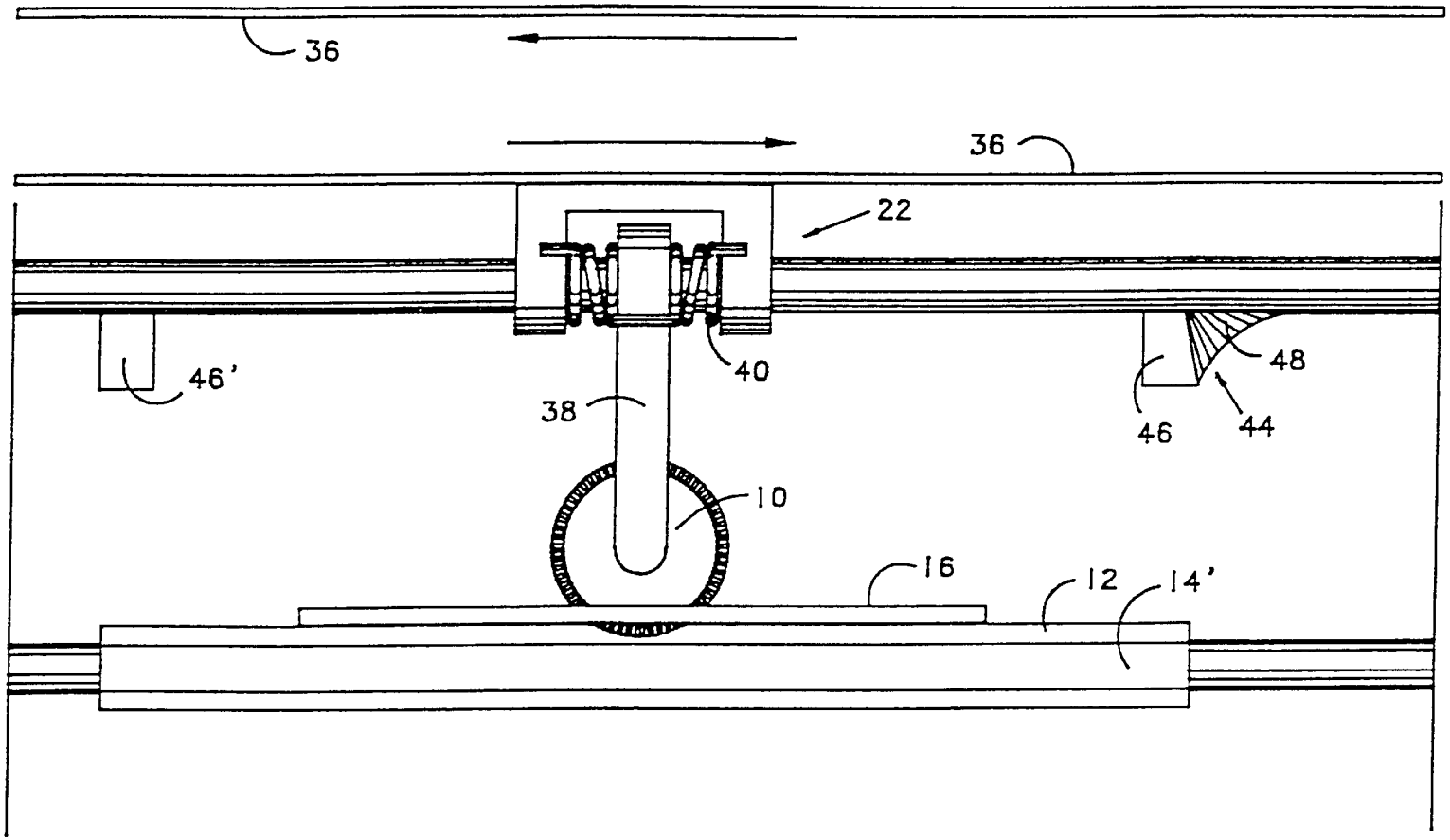
FIG. 15 is a back view of cutting apparatus according to the present invention including a rotatable backing bar and replaceable cutting blade wheel shown in the process of cutting.

With the carriage assembly 22 positioned as in FIG. 14, the media 16 can be moved by the feed rollers 30 until a point of cutting is reached. At that point, the feed rollers 30 stop feeding the media 16 and the drive belt 36 is employed to move the carriage assembly 22 towards the cam member 44, as depicted in FIG. 15, thereby causing the blade wheel 10 to cut the media 16 in combination with the presently active cutting edge 12 of the backing bar 14'. At all times during the cutting of the media 16 the blade wheel 10 is held against the cutting edge 12 by the biasing action of the spring 40 because the follower wheel 42 is not in contact with the cam member 44 as depicted in FIG. 18.

Figure 16:
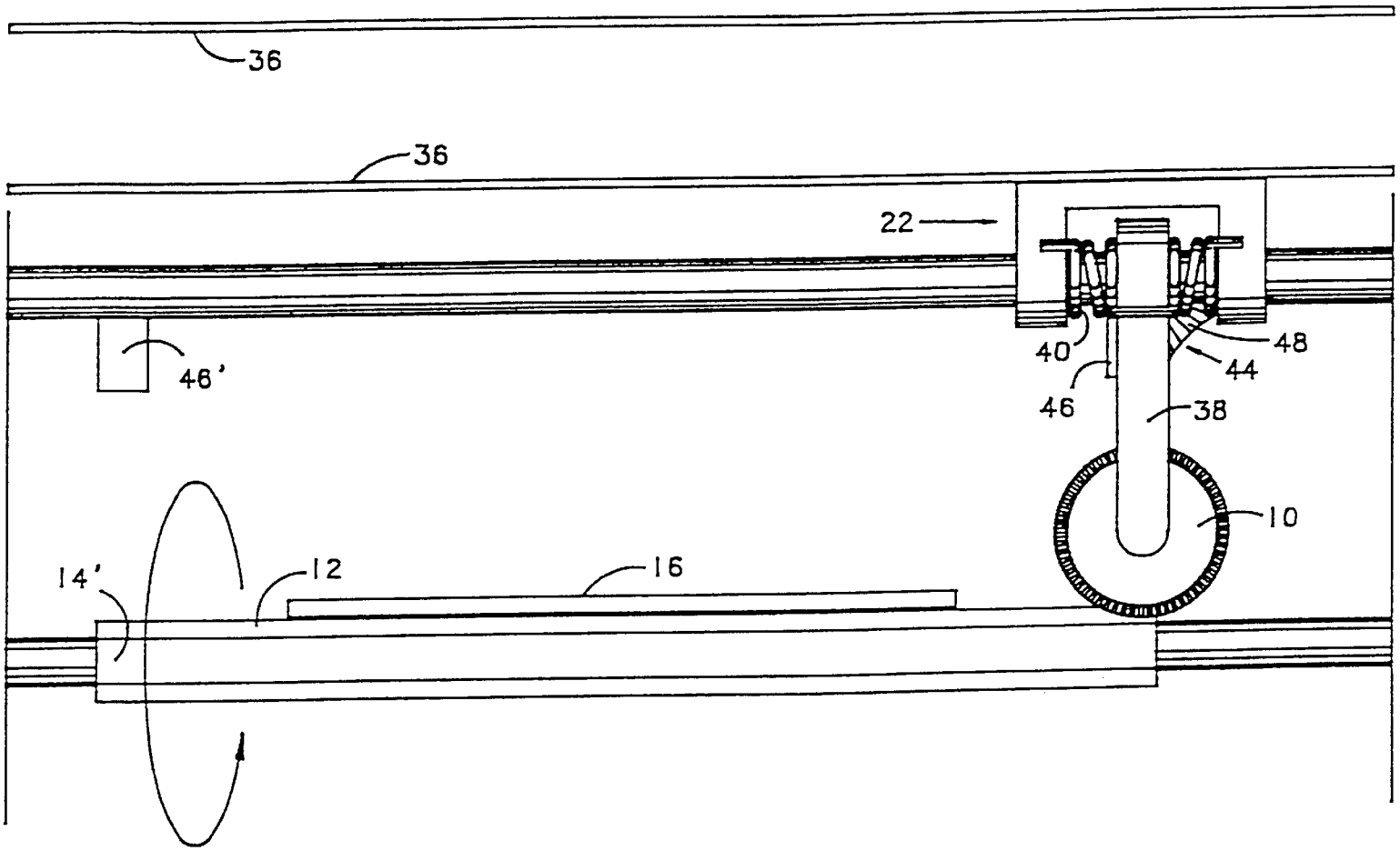
FIG. 16 is a back view of cutting apparatus according to the present invention including a rotatable backing bar and replaceable cutting blade wheel shown following cutting with the cutting blade wheel displaced from the backing bar by a cam member so that the backing bar can be rotated to a new position.
Figures 18, 19, 20:
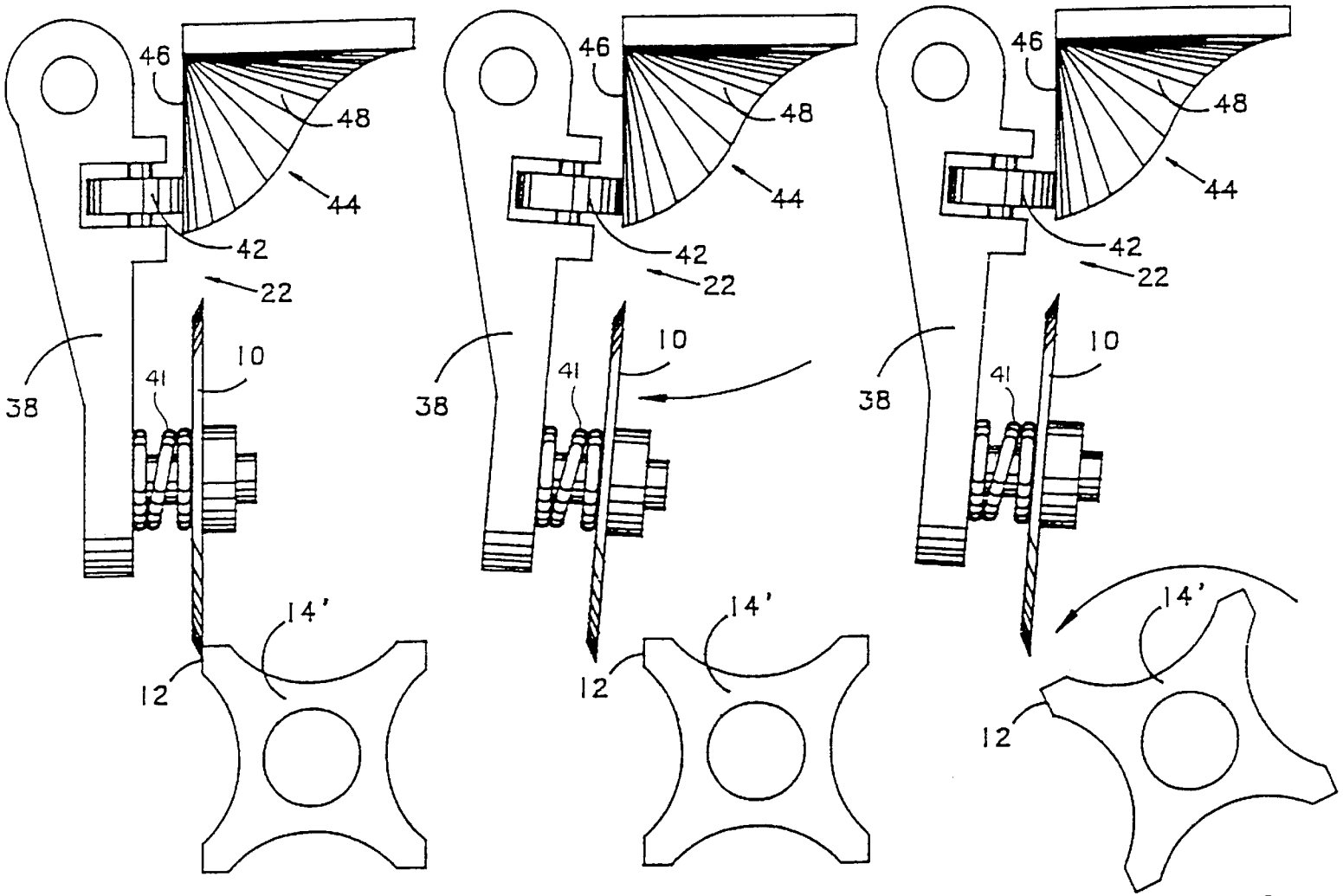
FIG. 18 is an enlarged end view of the apparatus of FIGS. 14–17 shown with the follower wheel of the cutting blade wheel carriage assembly not yet in contact with the cam member.
FIG. 19 is an enlarged end view of the apparatus of FIGS. 14–17 shown with the follower wheel of the cutting blade wheel carriage assembly in contact with the cam member at a first position corresponding to FIG. 16 prior to rotation of the backing bar.
FIG. 20 is an enlarged end view of the apparatus of FIGS. 14–17 shown with the follower wheel of the cutting blade wheel carriage assembly in contact with the cam member at the first position corresponding to FIG. 16 during rotation of the backing bar.

Periodically or at the end of each media cut, the carriage assembly 22 is moved to a first position as shown in FIG. 16 where the follower wheel 42 contacts a first portion 46 of the cam member 44 causing the blade wheel 10 to be moved away from contact with the backing bar 14', as depicted in FIGS. 19 and 20, a sufficient distance that the backing bar 14' can be rotated to a new cutting edge position as described earlier. As those of ordinary skill in the art will undoubtedly recognize and appreciate, by adding a partial cam or station 46' on the other end which also allows the backing bar 14' to be rotated, as depicted in the figures, the cutting action can be made bi-directional.

Figure 17:
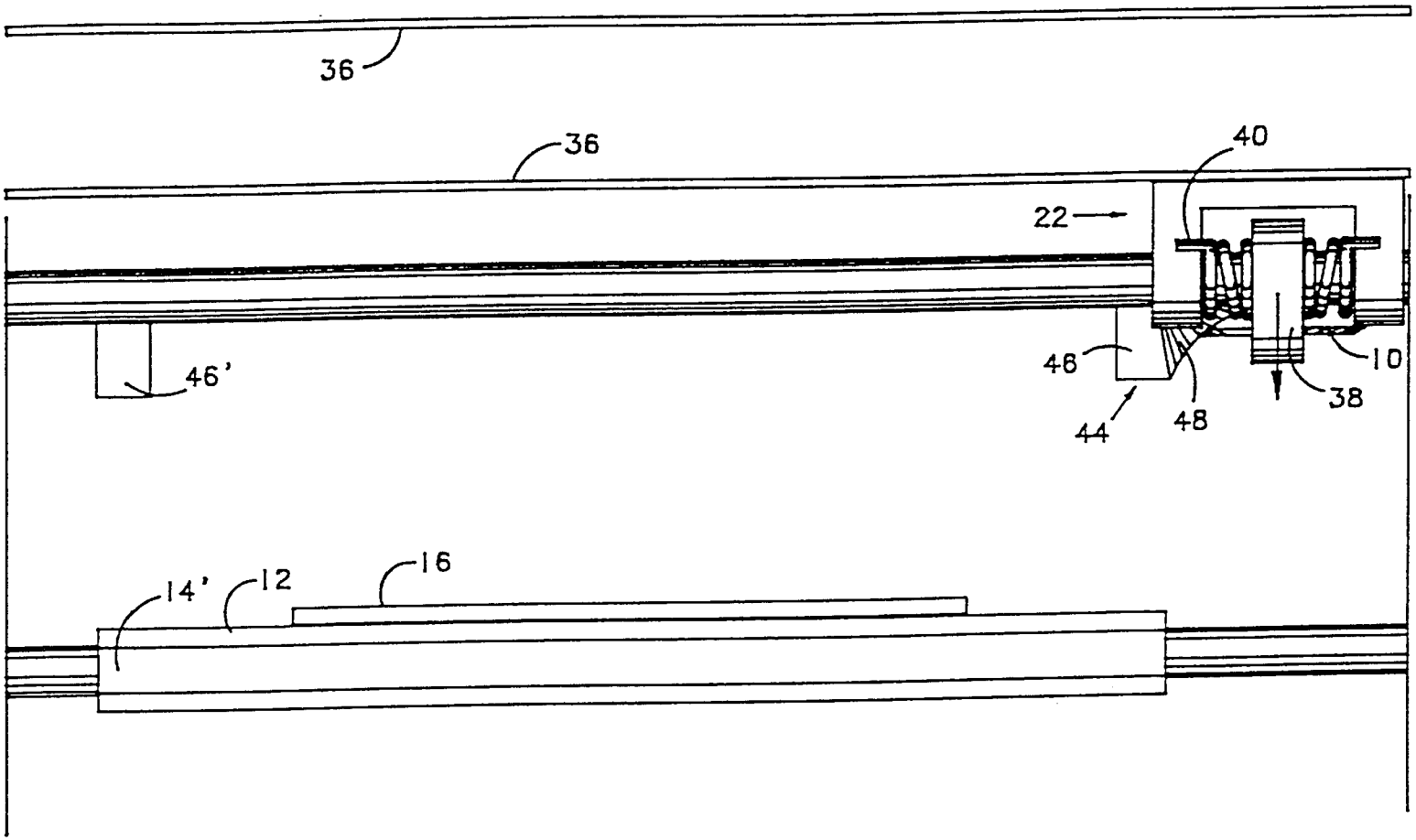
FIG. 17 is a back view of cutting apparatus according to the present invention including a rotatable backing bar and replaceable cutting blade wheel shown with the cutting blade wheel raised by the cam member so that the cutting blade wheel can be replaced.
Figure 22:
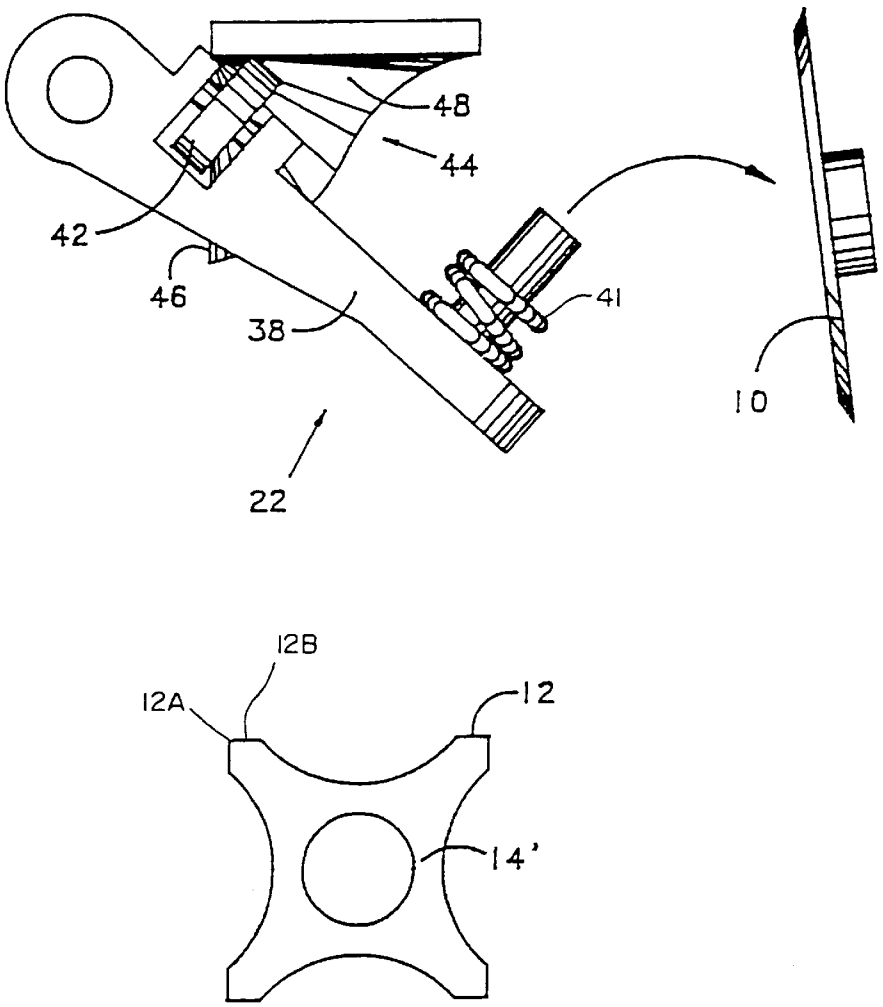
FIG. 22 is an enlarged end view of the apparatus of FIGS. 14–17 shown with the follower wheel of the cutting blade wheel carriage assembly in contact with the cam member at the second position corresponding to FIG. 17 and depicting how the cutting blade wheel can be replaced.
Figure 21:
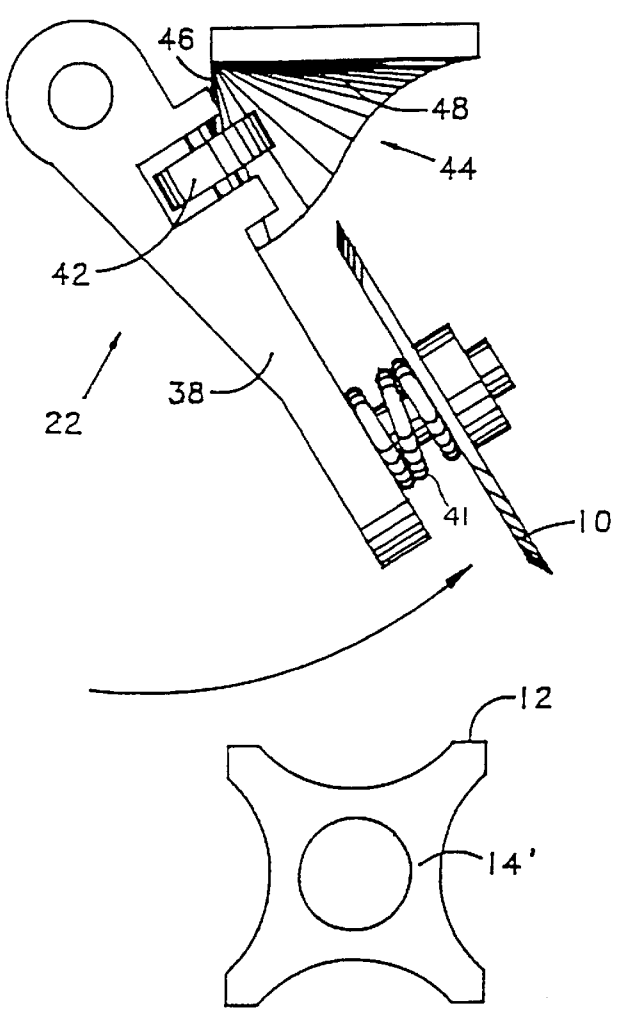
FIG. 21 is an enlarged end view of the apparatus of FIGS. 14–17 shown with the follower wheel of the cutting blade wheel carriage assembly in contact with the cam member following the first position and in the process of moving to a second position corresponding to FIG. 17.

When the changing of the blade wheel 10 is to be accomplished, the carriage assembly 22 is moved to a second position as shown in FIG. 17 where the follower wheel 42 contacts a second portion 48 of the cam member 44 causing the blade wheel 10 to pass over the end of the backing bar 14' to a horizontal position where the blade can be changed, as depicted in FIGS. 21 and 22.

As those of ordinary skill in the art will recognize and appreciate, the movement of the drive belt 36 will be under the control of control logic (not shown) operating the device in which the present invention is implemented. Thus, the control logic will automatically move the carriage assembly 22 to the first and second positions of the cam member 44 when the associated functions are to be accomplished.

Figure 24:
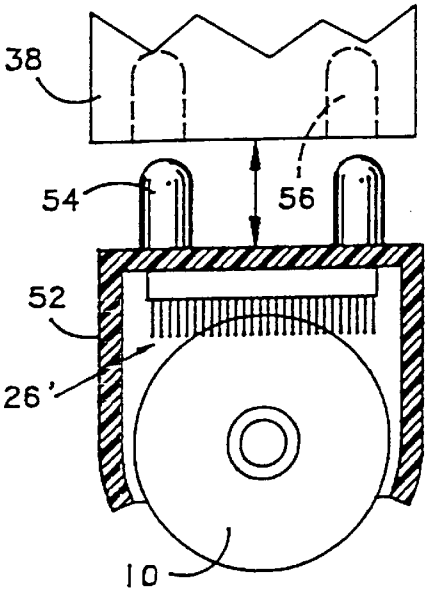
FIG. 24 is a partially cutaway drawing of a replaceable cutting blade wheel carried by a housing includes a wheel cleaner that is snapped into a pair of sockets in the cutting blade wheel carriage assembly provided therefor.
Figure 25:
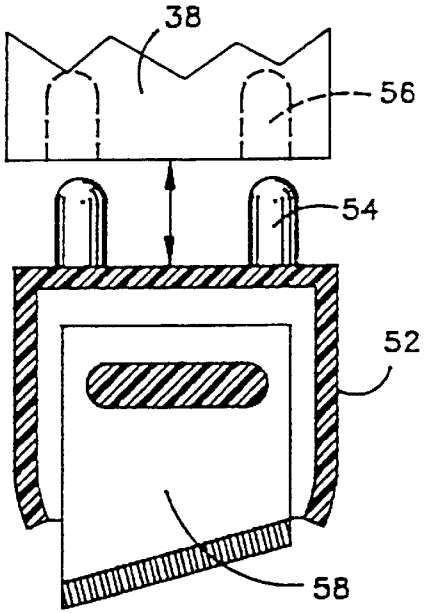
FIG. 25 is a partially cutaway drawing of a replaceable fixed cutting blade carried by a housing that is snapped into a pair of sockets in the cutting blade wheel carriage assembly provided therefor.
Figure 23:
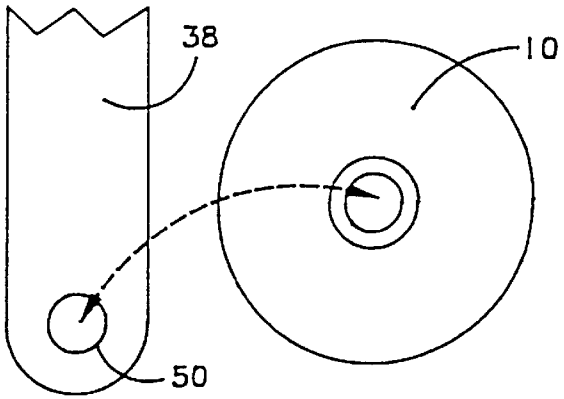
FIG. 23 is a drawing of a replaceable cutting blade wheel which is snapped onto a post of the cutting blade wheel carriage assembly provided therefor.

The replacement of the blade wheel 10 or other cutting device can be accomplished in various ways as depicted in FIGS. 23–25. In the simple approach of FIG. 23, the arm 38 is fitted with a post 50 onto which a new blade wheel 10 can be placed and held in place with a snap fit, retaining pin, or the like. In FIG. 24, the blade wheel 10 is mounted within a housing 52 having posts 54 which releasably fit into sockets 56 provided therefor in the end of the arm 38. If desired, a cleaning station 26' (wet or dry) can be included in the housing 52 to clean and lubricate the blade wheel 10. The housing approach can also be employed with a non-rotating blade 58 as depicted in FIG. 25.

In this latter regard, it should be remembered that one novel aspect of the present invention is the providing of an appropriate cutter with each roll of media 16. Employing the same backing bar 14', some media 16 may be more amenable to cutting with a fixed blade 58 while other media 16 may cut better with a rotating blade wheel 10. Additionally, the cutter blade material, finish, texture, or surface coating can be optimized for a given adhesive and/or media type. With the present invention, this is easily accomplished.

Wherefore, having thus described the present invention, what is claimed is:

1. A cutter assembly for strip media comprising:

a) cutter means having a cutting blade mounted to cut the media, transversely of the media and of a forward direction of movement of the media, at a point of cutting; and b) backing bar means forming a cylindrical supporting surface for the media; said supporting surface having an axis and comprising a plurality of resiliently flexible fingers circumferentially spaced to form said supporting surface, wherein the media is supported by a pair of adjacent fingers and said cutter means pierces the media between said pair of adjacent fingers; each said finger extending parallel to said axis and transversely of the media.

2. The cutter assembly for strip media of claim 1 wherein:

said fingers are sufficient in number and spaced close enough together such that said backing bar means acts like a self-healing solid roller with respect to said cutter means.

3. The cutter assembly for strip media of claim 1 wherein:

said backing bar means is rotatable mounted; and said fingers are of a material that does not stick to adhesive whereby a cut portion of media having uncovered adhesive on a face thereof adjacent to said fingers can be advanced after cutting by rotation of said backing bar means.

4. The cutter assembly of claim 1, further comprising cleaning means for cleaning adhesive from said fingers.

5. A cutter assembly for strip media comprising:

a) a cutter having a cutting blade mounted to cut the media, transversely of the media and of a forward direction of movement of the media, at a point of cutting; and b) a backing bar forming a cylindrical supporting surface for the media; said supporting surface having an axis and comprising a plurality of resiliently flexible fingers circumferentially spaced to form said supporting surface, wherein the media is supported by a pair of adjacent fingers and said cutting blade pierces the media between said pair of adjacent fingers; each said finger extending parallel to said axis and transversely of the media.

6. The cutter assembly of claim 5, wherein said fingers are sufficient in number and spaced close enough together such that said backing bar acts like a self-healing solid roller with respect to said cutting blade.

7. The cutter assembly of claim 6, wherein said backing bar is rotatable mounted; and said fingers are of a material that does not stick to adhesive whereby a cut portion of media having uncovered adhesive on a face thereof adjacent to said fingers can be advanced after cutting by rotation of said backing bar.

8. The cutter assembly of claim 5, wherein said backing bar is rotatably mounted; and said fingers are of a material that does not stick to adhesive whereby a cut portion of media having uncovered adhesive on a face thereof adjacent to said fingers can be advanced after cutting by rotation of said backing bar.

9. The cutter assembly of claim 8, further comprising a cleaning station positioned to clean end portions of said fingers as said fingers are rotated, by rotation of said backing bar, out of a position supporting the media.

10. The cutter assembly of claim 7, further comprising a cleaning station positioned to clean end portions of said fingers as said fingers are rotated, by rotation of said backing bar, out of a position supporting the media.

11. The cutter assembly of claim 6, in which said backing bar is rotatable mounted; and which further comprises a cleaning station positioned to clean end portions of said fingers as said fingers are rotated, by rotation of said backing bar, out of a position supporting the media.

12. The cutter assembly of claim 5, in which said backing bar is rotatably mounted; and which further comprises a cleaning station positioned to clean end portions of said fingers as said fingers are rotated, by rotation of said backing bar, out of a position supporting the media.

13. A cutter assembly for strip media comprising:

a) a cutter having a cutting blade mounted to cut the media, transversely of the media and of a forward direction of movement of the media, at a point of cutting; and b) a backing bar having a cylindrical supporting surface for the media, said supporting surface having an axis and being formed by radially outer ends of a plurality of resiliently flexible fingers, wherein the media is supported by said ends of a pair of circumferentially adjacent fingers and said cutting blade pierces the media and said backing bar between said pair of adjacent fingers; each said finger extending parallel to said axis and transversely of the media.

14. The cutter assembly of claim 13, wherein said fingers are sufficient in number and are close enough together such that said backing bar acts like a self-healing solid roller with respect to said cutting blade.

15. The cutter assembly of claim 14, wherein said backing bar is rotatable mounted; and said fingers are of a material that does not stick to adhesive whereby a cut portion of media having uncovered adhesive on a face thereof adjacent to said fingers can be advanced after cutting by rotation of said backing bar.

16. The cutter assembly of claim 13, wherein said backing bar is rotatable mounted; and said fingers are of a material that does not stick to adhesive whereby a cut portion of media having uncovered adhesive on a face thereof adjacent to said fingers can be advanced after cutting by rotation of said backing bar.

17. The cutter assembly of claim 16, further comprising a cleaning station positioned to clean end portions of said fingers as said fingers are rotated, by rotation of said backing bar, out of a position supporting the media.

18. The cutter assembly of claim 15, further comprising a cleaning station positioned to clean end portions of said fingers as said fingers are rotated, by rotation of said backing bar, out of a position supporting the media.

19. The cutter assembly of claim 14, in which said backing bar is rotatably mounted; and which further comprises a cleaning station positioned to clean end portions of said fingers as said fingers are rotated, by rotation of said backing bar, out of a position supporting the media.

20. The cutter assembly of claim 13, in which said backing bar is rotatable mounted; and which further comprises a cleaning station positioned to clean end portions of said fingers as said fingers are rotated, by rotation of said backing bar, out of a position supporting the media.

* * * * *

UNITED STATES PATENT AND TRADEMARK OFFICE

CERTIFICATE OF CORRECTION

PATENT NO. : 6,135,001 
DATED : October 24, 2000
INVENTOR(S) : Jay Miazga, Pixie A. Austin and Duane M. Fox It is certified that error appears in the above-identified patent and that said Letters Patent is hereby corrected as shown below:

Title page,
Item [75], Inventors, the residence of Duane M. Fox should be listed as -- Snohomish, Wash. --.

Column 2,
Line 37, "another, embodiment" should be -- another embodiment --.

Column 4,
Lines 5 and 6, "housing includes a wheel cleaner", should be -- housing that includes a wheel cleaner and --.
Line 51, "invention as is the" should be -- invention. The --.
Line 53, after "anvil surfaces", insert -- is also to be considered within the scope and spirit of the invention --.

Column 5,
Line 2, delete "14''',".
Line 3, "14A''',," should be -- 14A, 14''' --.
Line 6, "conduction" should be -- conjunction --.
Line 39, "the", second occurrence, should be -- a --.

Column 6,
Line 64, "rotatable" should be -- rotatably --.

Column 7,
Lines 24 and 44, "rotatable" should be -- rotatably --.

Column 8,
Lines 21, 27 and 47, "rotatable" should be -- rotatably --.

Signed and Sealed this

Seventeenth Day of September, 2002

*Attest:*

*Attesting Officer*

JAMES E. ROGAN
*Director of the United States Patent and Trademark Office*